US008286904B2

(12) United States Patent
Pellengo Gatti

(10) Patent No.: US 8,286,904 B2
(45) Date of Patent: Oct. 16, 2012

(54) METHOD, MANDREL AND APPARATUS FOR WINDING UP AND REMOVING CORELESS ROLLS OF STRETCH FILM

(75) Inventor: Roberto Pellengo Gatti, San Pierto Mosezzo (IT)

(73) Assignee: No. El. S.R.L., San Pietro Mosezzo (IT)

( * ) Notice: Subject to any disclaimer, the term of this patent is extended or adjusted under 35 U.S.C. 154(b) by 0 days.

(21) Appl. No.: 13/318,615

(22) PCT Filed: May 12, 2010

(86) PCT No.: PCT/EP2010/056554

§ 371 (c)(1),
(2), (4) Date: Nov. 3, 2011

(87) PCT Pub. No.: WO2010/133495

PCT Pub. Date: Nov. 25, 2010

(65) Prior Publication Data

US 2012/0048987 A1 Mar. 1, 2012

(30) Foreign Application Priority Data

May 18, 2009 (IT) ..... MI09A0865

(51) Int. Cl.
*B65H 19/22* (2006.01)

(52) U.S. Cl. ..... 242/533; 242/532.2; 242/576.1

(58) Field of Classification Search ..... 242/532.1, 242/532.2, 533, 332.3, 576.1
See application file for complete search history.

(56) References Cited

U.S. PATENT DOCUMENTS

| | | | | |
|---|---|---|---|---|
| 3,856,226 | A | 12/1974 | Dowd, Jr. | |
| 5,337,968 | A | 8/1994 | De Bin et al. | |
| 6,186,436 | B1 * | 2/2001 | Selle et al. | 242/532.2 |
| 6,270,034 | B1 | 8/2001 | Kury et al. | |

(Continued)

FOREIGN PATENT DOCUMENTS

EP 0 831 047 A1 3/1998

(Continued)

OTHER PUBLICATIONS

International Search Report Dated Jul. 20, 2010 Issued in PCT/EP2010/056554. Written Opinion of the International Searching Authority, Dated Jul. 20, 2010 Issued in PCT/EP2010/056554.

*Primary Examiner* — Sang Kim
(74) *Attorney, Agent, or Firm* — Lucas & Mercanti, LLP

(57) ABSTRACT

One or a plurality of coreless rolls of a stretchable plastic film are wound up on a mandrel (10) having a tubular body; the mandrel (10) comprises at least a fore air chamber (14) and a rear air chamber (15) axially aligned, wherein the peripheral wall (11) of the mandrel (10) comprises a perforated zone (16, 17) in correspondence of each air chamber (14, 15). One or a plurality of coreless rolls (B1, B2) of stretchable plastic film are wound up on the mandrel (10) at said perforated zones (16, 17) and air chambers (14, 15); the roll or rolls (B1, B2) are removed by pushing said roll or rolls along the mandrel (10), by supplying pressurized air initially into all air chambers (14, 15) during a first removal step of the roll or the rolls (B1, B2) and selectively disconnecting each chamber (14, 15) from the pressurized air source, starting from the rear air chamber (15) to the fore air chamber (14) at overcoming of each air chamber (14, 15) by said roll or rolls (B1, B2).

11 Claims, 5 Drawing Sheets

U.S. PATENT DOCUMENTS

| | | | | |
|---|---|---|---|---|
| 6,595,458 | B1 | 7/2003 | Biagiotti | |
| 7,100,864 | B2 * | 9/2006 | Weis | 242/615.12 |
| 7,775,475 | B2 * | 8/2010 | Tanaka et al. | 242/532.2 |
| 7,942,363 | B2 * | 5/2011 | Gelli et al. | 242/532.2 |

FOREIGN PATENT DOCUMENTS

| | | | |
|---|---|---|---|
| EP | 0 995 708 | A2 | 2/2000 |
| EP | 1 813 534 | A1 | 8/2007 |
| WO | 2006/012933 | A1 | 2/2006 |

* cited by examiner

METHOD, MANDREL AND APPARATUS FOR WINDING UP AND REMOVING CORELESS ROLLS OF STRETCH FILM

This application is a U.S. national stage of PCT/EP2010/056554 filed on May 12, 2010 which claims priority to and the benefit of Italian Application No. MI 2009A000865 filed on May 18, 2009, the contents of which are incorporated herein by reference.

BACKGROUND OF THE INVENTION

The present invention relates to the formation of coreless rolls of a stretchable plastic film, also referred to as stretch film, which is wound up on a special perforated mandrel conformed for enabling one or a plurality of coreless rolls to be simultaneously wound up and sequentially removed, wherein use is made of a pressurised air flow for causing some internal turns of the rolls to radially expand, so that said coreless rolls are made easy to be frictionless removed preventing the implosion of the rolls due to compaction and self-adhesion of a number of internal turns close to the mandrel. In particular, the invention is directed to a method as well as to a mandrel and an apparatus for winding up coreless rolls of a stretch film, the mandrel and the apparatus being suitable for actuating said method.

The invention has a particular application in the field of stretchable plastic films, normally used for packaging or for winding up palletized loads, or other similar applications, wherein the demands for improving the working cycle, reducing the costs for forming the rolls, as well as simplifying the problems for managing said rolls, result always more relevant.

Stretchable plastic films hold a preeminent position in packaging due to their excellent functional qualities; one of the characteristics that are distinguishing a stretchable plastic film from any other web material is its "cling", that is the ability of the stretchable plastic film to adhere to itself creating a seal on the package.

Mechanical properties of a stretch film are also relevant in relation to the tear and pull resistance, with stretch values up to 100-140% and more, and a relatively low Young's modulus; use of stretch film in packaging have proved to reduce the amount of film consumption as much as 40-50%.

Furthermore use of correctly wound up coreless rolls of stretch-films having a number of compacted internal turns, which maintain a cylindrical shape of the rolls after the removal from the mandrel, that is suitably conformed to avoid any risk of implosion and deformation of their cylindrical shape, is a very relevant characteristic that makes the packaging and wrapping of palletized loads by stretch films, easier and faster, with significantly higher output. Therefore, the use of stretchable plastic films, in respect to other web materials and different technical fields, is very important.

BACKGROUND ART

Various products such as paper, plastic films and similar, are typically obtained in the form of a continuous web that is wound up in rolls of large diameter, which must then be re-wound in rolls of smaller size.

Generally, with conventional winding systems the web material is wound up over a rigid tubular core of paperboard or other suitable material for providing a support to the turns of the film during winding; however, the use of usual rigid cores involves a more elaborate procedure for forming the rolls, as well as higher costs for stocking up and eventually disposing the tubular cores.

In order to solve the problems connected with the use of usual tubular cores, winding apparatuses were already proposed that employ a special perforated mandrel, onto which a coreless roll of stretch film is directly wound up and wherein the use of rigid tubular cores is totally eliminated; at the end of the winding up step of a roll, a pressurised air flow is supplied into the perforated mandrel, which pressurised air escapes from through holes of the mandrel in order to reduce the frictional forces between contact surfaces of the same mandrel and the inner turns of the roll, allowing compaction of the inner turns, sliding and the removal of the same roll.

An apparatus comprising a perforated mandrel for winding up coreless rolls is already known for example from WO 2006/012933 of the same applicant, in particular for winding up stretchable plastic films for packaging and wrapping palletized loads. WO 2006/012933 discloses a method for winding up and removing coreless rolls of a stretchable plastic film from a mandrel comprising a tubular body having a peripheral wall provided with a plurality of perforations or through holes longitudinally arranged from a rear to a fore end of the mandrel, and means for feeding pressurised air into the tubular body of the mandrel and outflowing through the perforations during the removal of a roll. The tubular body of the mandrel is conformed with a single air chamber at a perforated zone of peripheral wall of the mandrel, on which at least one roll may be wound up, whereby connecting the air chamber of the mandrel to a pressurized air, the compaction of the internal turns of the roll and the removal of the same roll is allowed while air flowing through uncovered perforations of the mandrel. Other examples of apparatuses, employing perforated mandrels for winding up coreless rolls of web materials in different technical fields, are found in EP-A-0831047, EP-A-0995708, U.S. Pat. Nos. 6,270,034 and 6,595,458.

A problem common to the apparatuses employing conventional perforated mandrels, relates to the difficulty of controlling the flow rate and the consumption of pressurised air during the removal of the rolls; actually, the flow rate of air supplied to the mandrel varies during the removal of the rolls, said flow rate being increased as the rolls progressively uncover the holes of the mandrel, in order to compensate for any pressure drop.

Furthermore, winding up one or a plurality of rolls on a same mandrel in order to increase the output of the productive process, and then removing and taking off the rolls by keeping the consumption of pressurised air at a minimum, result quite impossible with the usual perforated mandrels.

Actually, in all the previously mentioned documents, the mandrel is conformed with a tubular body, delimited by a peripheral wall comprising a plurality of perforations or through-holes, and a single air chamber for supplying a pressurised air flow, in which the chamber axially extends over the total length of the mandrel, from a rear to a fore end; consequently, the air flow must be progressively increased during the removal of the rolls.

In order to reduce the pressure drops and to keep a cushioning air flow as homogeneous as possible between the mandrel and a mattress or other wound soft product, EP-A-1813534 discloses an apparatus comprising a perforated tubular mandrel, partitioned into separate compartments or hermetically sealed rear and fore chambers, which may be conjointly connected to a single source of pressurised air. The use of two air chambers both permanently connected to a pressure air source during the removal of rolls is proposed in order to reduce the pressure drops, by keeping a homogeneous cushioning of air whilst the wound mattress is taken off.

Since both rear and fore air chambers result always connected with the pressurised air source, during all the time required for removing the mattress, this again implies the need of progressively increasing the flow rate of the pressurised air, and consequently of increasing the consumption of air as the holes of the mandrel are progressively uncovered.

OBJECT OF THE INVENTION

The main object of the present invention is to provide a method and a mandrel for winding up coreless rolls of a stretchable plastic film, normally used for packaging and wrapping palletized loads, by means of which the winding up of one or a plurality of coreless rolls as well as the removal of said rolls is made possible by supplying pressurised air in a controlled mode, so as to reduce the pressure drop, enabling at the same time the consumption of air to be substantially reduced.

A still further object of the present invention is to provide an apparatus so as to enable one or more coreless rolls of stretchable plastic film to be wound up on a same mandrel, and to be selectively removed under controlled conditions, by keeping a high output degree.

The problem to be solved by the present invention regards the maintaining of an air cushion most homogeneous possible during removal of coreless rolls of stretchable plastic films, in a manner suitable to reduce air consumption and pressure losses; therefore the general object of the invention is to provide an alternative solution to solve the above cited problem.

All above is achievable by a method according to claim 1, by the use of a perforated mandrel according to claim 5, as well as by means of an apparatus according to claim 10.

In general term, the invention consists in winding-up and removing one or a plurality of coreless roll of a stretchable plastic film, providing a mandrel comprising a tubular body conformed with at least a first fore air chamber and a second rear air chamber, axially aligned at respective fore and rear perforated zones of a peripheral wall of the mandrel, in which the air chambers of the mandrel are connectable to a pressurised air source by a duct system comprising selectively actuable control valves, the coreless roll or the plurality of coreless rolls are removed initially feeding pressurised air in all the air chambers of the mandrel during a first removal step of the roll or rolls, and subsequently selectively disconnecting the air chambers from the pressurised air source, starting from the rear air chamber towards the fore air chamber of the mandrel.

As previously stated, the supply of pressurised air is selectively interrupted starting from the rear air chamber towards the fore air chamber of the mandrel; a pushing member and the use of position sensors enable all the rolls to advance, to control the position of said rolls and to selectively supply the pressurised air into the air chambers of the mandrel.

The apparatus according to the invention can be provided with a single winding mandrel or with a plurality of idle rotating mandrels supported by a turntable wheel, which is controlled to step-by-step rotate in order to move each single mandrel along a circular path, between a first winding up position and a roll removal position, intermediate positions being provided for stabilization of the already wound up rolls.

BRIEF DESCRIPTION OF DRAWINGS

These and further features of the invention, together with some preferred embodiments, will be disclosed more in detail in the following, with reference to drawings, in which.

DETAILED DESCRIPTION OF THE INVENTION

With reference to the FIGS. 1 to 4, the general features of the invention will be now disclosed, and a preferred embodiment of a mandrel conformed for simultaneously winding up two rolls of stretchable plastic film. It is stated that, all will be said about the mandrel of FIG. 1, and relative apparatus of FIG. 2, can be extended also to a mandrel and an apparatus conformed for simultaneously winding up a plurality of rolls, at the same time.

Figure 1:
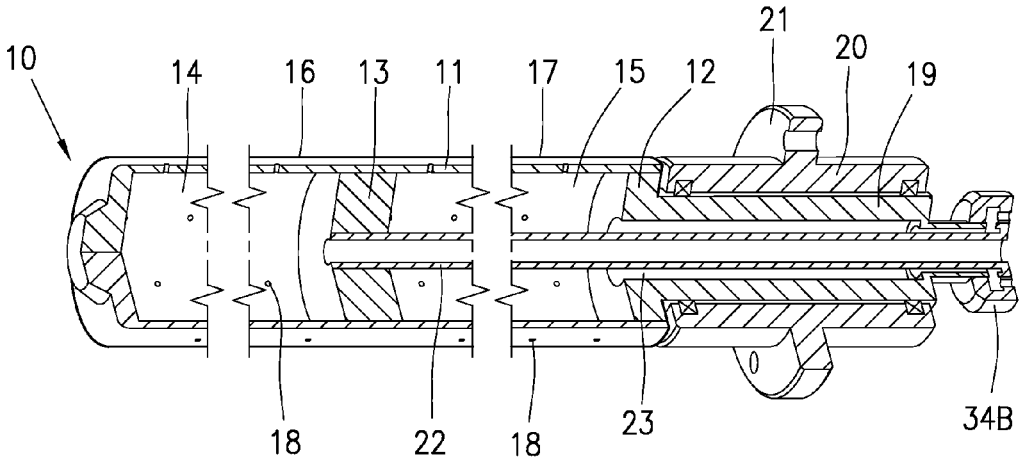
FIG. 1 is a longitudinal cross sectional view of a mandrel according to the invention.

As shown in FIG. 1, a cylindrical mandrel 10 comprises a tubular body having a cavity, closed at both ends; the mandrel 10 is provided with a peripheral wall 11 having a plurality of perforations or through holes arranged on perforated zones extending from the rear to the fore end of the mandrel 10; a rear closure member 12 and an intermediate partition wall 13 divide the cavity of the mandrel in two separate, axially aligned, air chambers, specifically a first fore air chamber 14 and a second rear air chamber 15.

Each air chamber 14 and 15 is delimited by a perforated zone 16 and 17 for winding up rolls, having a plurality of through holes 18 enabling the outflowing of a pressurised air, selectively supplied into the two air chambers 14, 15 as disclosed below.

The mandrel 10 and the perforated zones 16 and 17 can be of any length in relation to the size of the plastic film rolls to be wound up.

The mandrel 10 is supported to freely rotate according to any suitable mode; in the case of FIG. 1, the rear closure member 12, at the side opposed to the air chamber 15, is provided with a tubular shaft 19 axially extending into a support sleeve 20. The support sleeve 20 is provided with a flange 21 arranged for fastening the supporting sleeve 20 to a frame of a winding machine.

Figure 3:
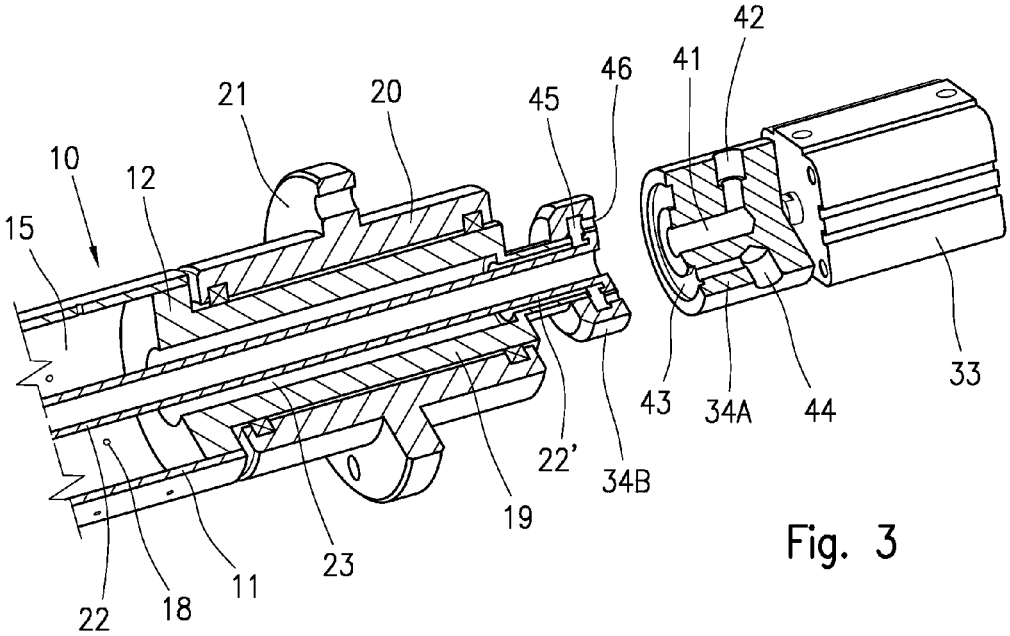
FIG. 3 is an enlarged detail of a pneumatic coupling device for connecting the mandrel to pressurised air source.
Figure 4:
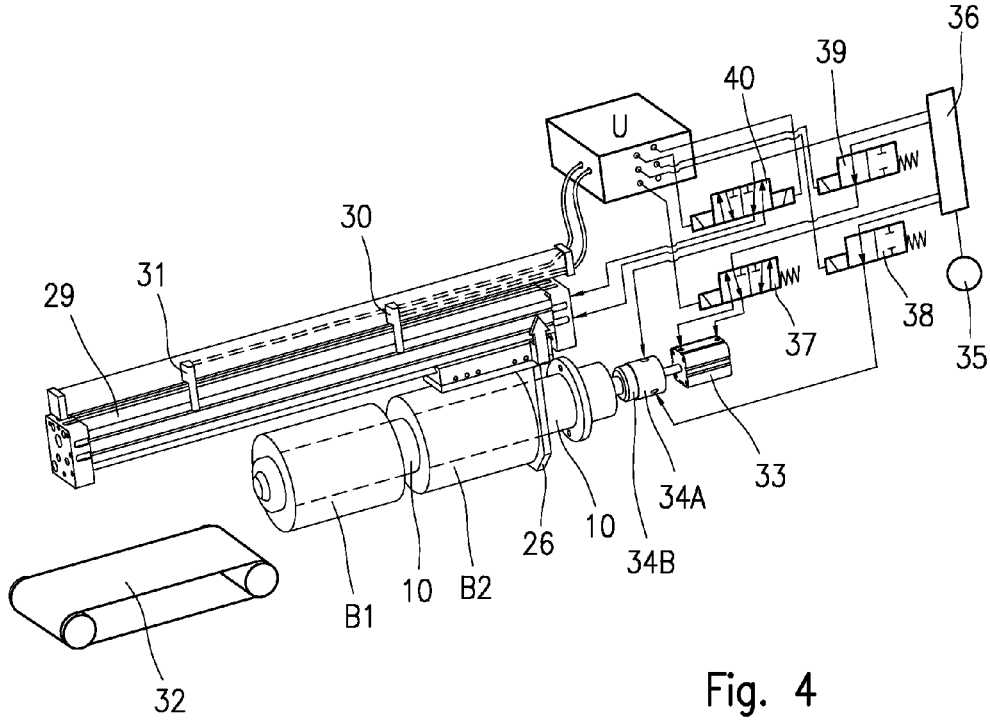
FIG. 4 is a view like FIG. 3 at the end of the winding step of two coreless rolls.

As shown in FIG. 1 and in the detail of FIG. 3, the mandrel 10 is provided with a duct system and air passageways suitable for enabling the two air chambers 14 and 15 to be separately connected to a pressurised air source.

In particular, the system for supplying pressurised air comprises, in the shown example, a central tube 22 that axially extends into the mandrel, from the rear end, along the tubular shaft 19, the rear air chamber 15 and through a middle partition wall 13, up to communicate with the fore air chamber 14. The tube 22 partially protrudes with its rear end 22', from the tubular shaft 19, up to a pneumatic coupling device for connecting said tube 22 to a pressurised air source by a solenoid valve control system, suitable for selectively supplying pressurised air into the air chambers of the mandrel, as explained below; furthermore, the outer diameter of the tube 22 for supplying pressurised air to the fore air chamber 14, is smaller than the inner diameter of the tubular shaft 19 so as to conjointly form an annular duct 23 for supplying pressurised air to the rear air chamber 15.

For all described and shown in FIG. 1, a first innovative aspect of the invention therefore resides in a tubular mandrel 10 for winding up coreless rolls of a stretchable plastic film, conformed with a peripheral wall 17 provided with a plurality of holes 18 at perforated zones extending along separate air chambers 14, 15, and a system of solenoid valves and air ducts which enable the two chambers 14 and 15 to be separately and selectively connected to a pressurised air source, in which the pressurised air can outflow through perforations or holes 18 along the roll winding zones 16, 17.

Figure 2:
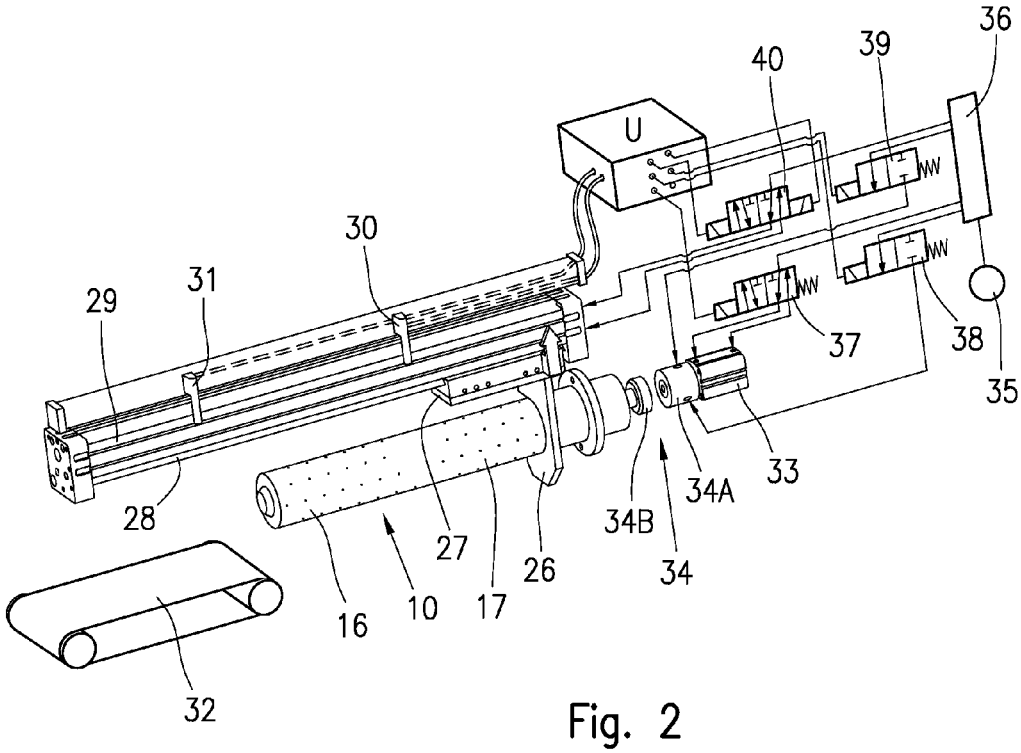
FIG. 2 is a perspective view of an apparatus for winding up coreless rolls of a stretchable plastic film, comprising the mandrel of FIG. 1, before the rolls are wound up.

FIG. 2 shows the main parts of an apparatus for simultaneously winding up two coreless rolls of plastic film, said apparatus making use of the mandrel 10 of FIG. 1; the apparatus comprises a pneumatic coupling device 34 and a plurality of solenoid control valves for selectively connecting the air chambers 14, 15 of the mandrel 10 to a pressurised air source.

In FIG. 2, the same reference numbers of FIG. 1 were used for indicating similar or equivalent parts of the mandrel 10. The apparatus comprises a C-shaped roll pushing device 26, for removing and causing the rolls of plastic film to slide along the mandrel 10. The pushing device 26 is fastened to a slide 27 moving along longitudinal guide rails 28 of a pneumatic cylinder 29; the slide 27 is connected to the piston of a double-acting pneumatic cylinder 29, of rod-less type, which extends from the rear end to the fore end and beyond of the mandrel 10.

A pair of sensors 30, 31 detects the position of the pushing device 26 along a working stroke. The sensors 30, 31 can be directly or indirectly fixed to the cylinder 29, in a manner to be adjustable in position. The sensors 30 and 31 can be of any suitable type; for example said sensors 30 and 31 can be magnetic sensors detecting the position of the slide 27 or the piston of the control cylinder 29, or said sensors 30 and 31 can be of optical, or of other type, or can consists of limiting switches.

As shown by FIG. 2 and the enlarged detail of FIG. 3, the chambers 14 and 15 of the mandrel 10, the cylinder 29 for controlling the pushing device 26, and a double-acting cylinder 33 for controlling the pneumatic coupling device 34 can be selectively connected to a pressurised air source 35 via an air distributor 36 and a group of solenoid valves 37, 38, 39 and 40, suitable for being selectively actuated by an electronic control unit U, according to a predetermined working sequence.

In particular, the first solenoid valve 37 is of mono-stable, four-ways type, for supplying pressurised air to the double-acting cylinder 33 which control the pneumatic coupling device 34; the second solenoid valve 38 is of mono-stable, two-ways type for supplying pressurised air to a first inlet of the pneumatic coupling device 34, connected by the tube 22 to a first air chamber such as the fore air chamber 14; the third solenoid valve 39 is again of mono-stable, two-ways type, for supplying pressurised air to a second inlet of the pneumatic coupling device 34, connected by the annular duct 23 to a second air chamber such as the rear air chamber 15; eventually, the fourth solenoid valve 40 is of bistable, four-ways type, for supplying pressurised air to the double-acting cylinder 29 which control the pushing device 26.

The pneumatic coupling device 34 for connecting the air chambers 14 and 15 to the pressurised air source 35, can be of any suitable type for a selective connection via the solenoid valves 38, 39, controlled by the electronic control unit U. According to the example of FIG. 3, the pneumatic coupling device 34 comprises a first coupling member 34A, fixed to the rod of the cylinder 33, and a second coupling member 34B fixed to the rear end of the mandrel 10.

The first coupling member 34A is provided with a front open axial hole 41, connected to a first radial hole 42 for feeding of the air; the coupling member 34A further comprises a front open annular groove 43, coaxially arranged to the hole 41, connected to a second radial hole 44 for feeding of the air.

The second coupling member 34B comprises in turn an extension 22' of the tube 22 for supplying the air to the first chamber 14 of the mandrel 10, said extension 22' being suitable to be tightly connected to the axial hole 41 of the coupling member 34A. The second coupling member 34B further comprises a second annular groove 45 coaxially arranged with respect to the extension 22' of the tube 22; thus, the annular groove 45 communicates, at one side, with the extension 22' of the tube 22, whereas, at the opposed side, in the closed condition of the coupling device 34, said annular groove 45 can communicate with the annular groove 43 of the first coupling member 34A via a crown of holes 46. Both coupling members 34A and 34B are provided with flat facing surfaces for an air-tight connection, as shown in FIG. 3.

Figure 8:
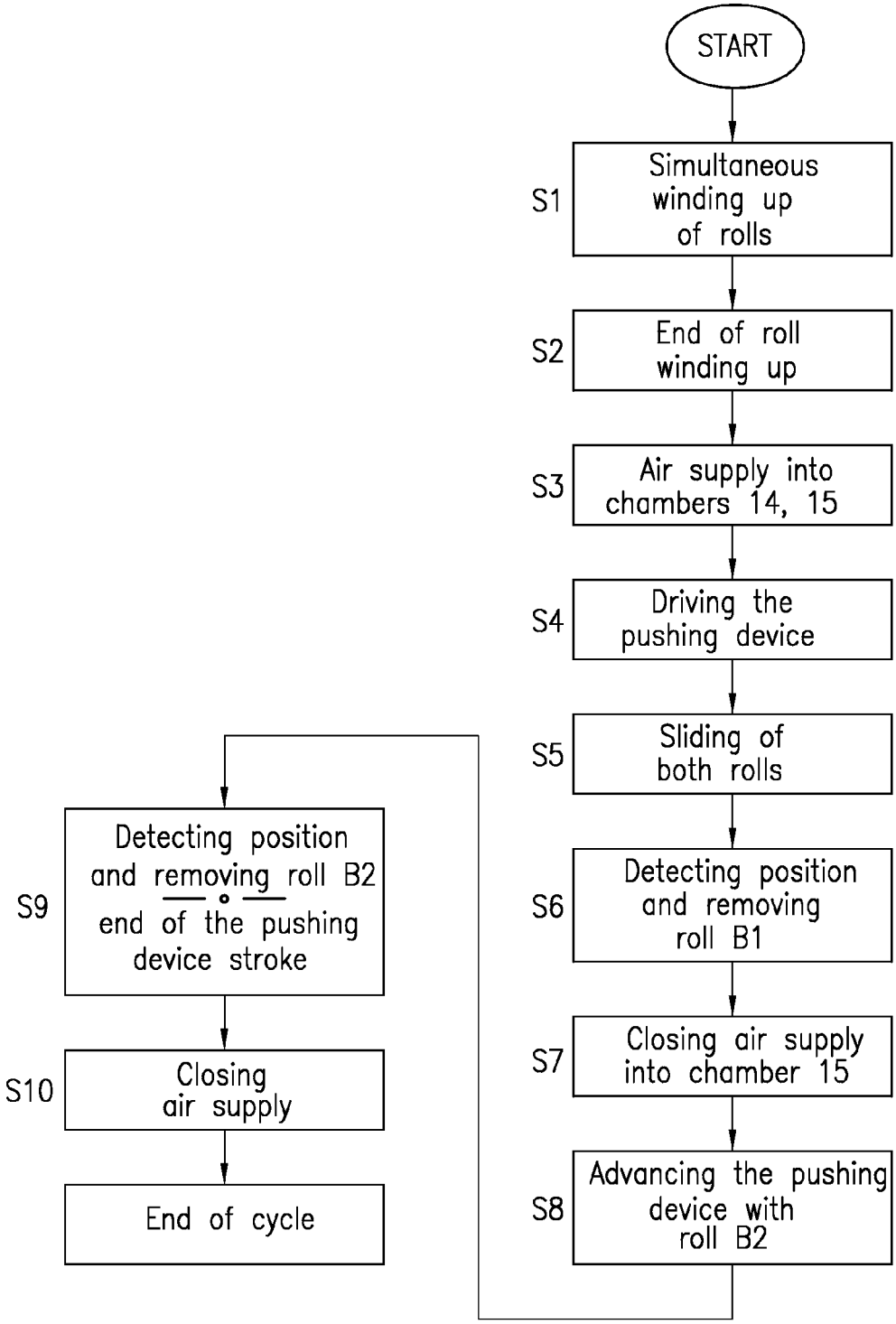
FIG. 8 is a flow chart showing the operative method of the apparatus of the previous figures.

With reference now to the remaining figures, in particular the flow diagram of FIG. 8, the operative mode of the apparatus will be disclosed and the main steps of the method according to the present invention will be explained.

Initially, START, the pneumatic coupling device 34 is open, since its movable coupling member 34B is in the rearmost position of FIG. 2. Therefore, the supply of pressurised air into the chambers 14 and 15 of the mandrel 10 is prevented, since the solenoid valves 38 and 39 are closed; furthermore, the pushing device 26 is in the rearmost position of FIG. 2. At this point, coreless rolls B1 and B2 can be simultaneously wound up on the mandrel 10, which may freely rotate, since the rolls are rotatably drawn, in a per se known manner, step S1, by a driving roll, not shown. When a predetermined amount of plastic film has been wound on the rolls B1 and B2, FIG. 4, on the basis of a working program stored in the electronic control unit U, winding up is stopped, step S2, while starting the removal of the rolls B1, B2, FIG. 5.

In particular, the control unit U allows opening of the solenoid valve 37 to connect the cylinder 33 to the pressurised air source 35; therefore, the pneumatic coupling device 34 is closed by advancing the movable coupling member 34B against the coupling member 34A connected to the mandrel 10. The solenoid valve 37 is then deactivated while both solenoid valves 38, 39 are activated for connecting both air chambers 14 and 15 of the mandrel 10 to the pressurised air source 35; thus, both chambers 14 and 15 are supplied with pressurised air, step S3. The pressurised air simultaneously supplied into both chambers 14 and 15 of the mandrel 10, outflowing the holes 18 causes a radial expansion and compaction of the internal turns of the rolls B1 and B2 close to the same mandrel 10, with consequent removal of the frictional contact between the outer surface of the mandrel 10 and the inner surfaces of the rolls B1, B2, enabling thus said rolls B1, B2 to be rapidly removed.

Figure 5:
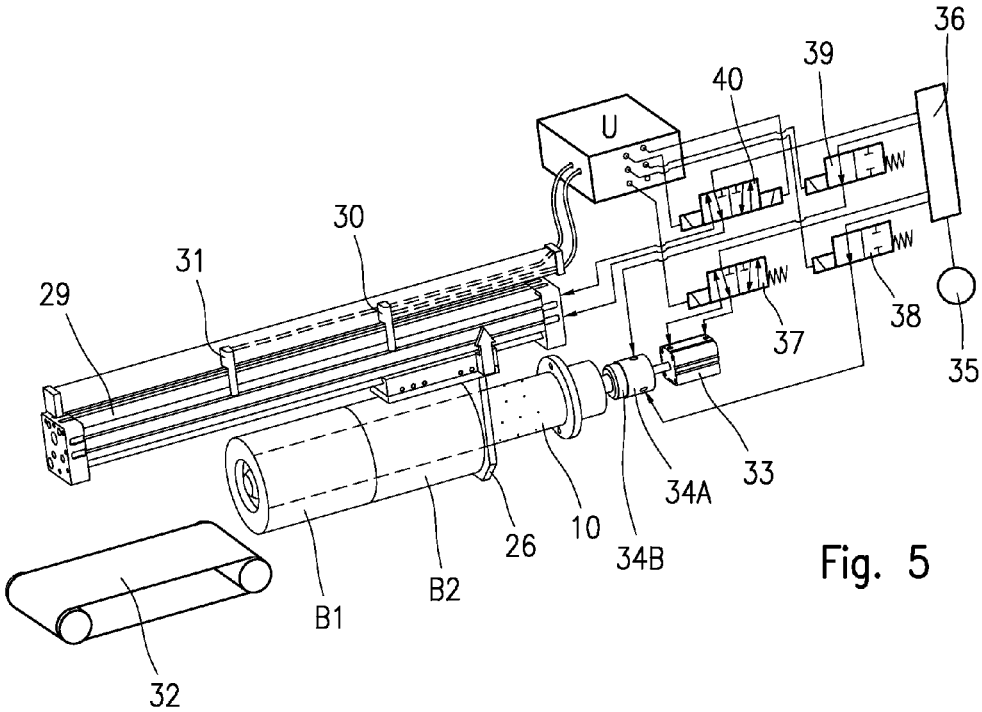
FIG. 5 is a view like FIG. 4 showing the starting step for the removal of the first roll.

In this regard, the control unit U opens the solenoid valve 40 to connect one side of the cylinder 29, which drives the pushing device 26, to the pressurised air source 35; consequently the pushing device 26 moves the rear roll B2 along the mandrel 10, step S4, towards and against the fore roll B1, as shown in FIG. 5.

Figure 6:
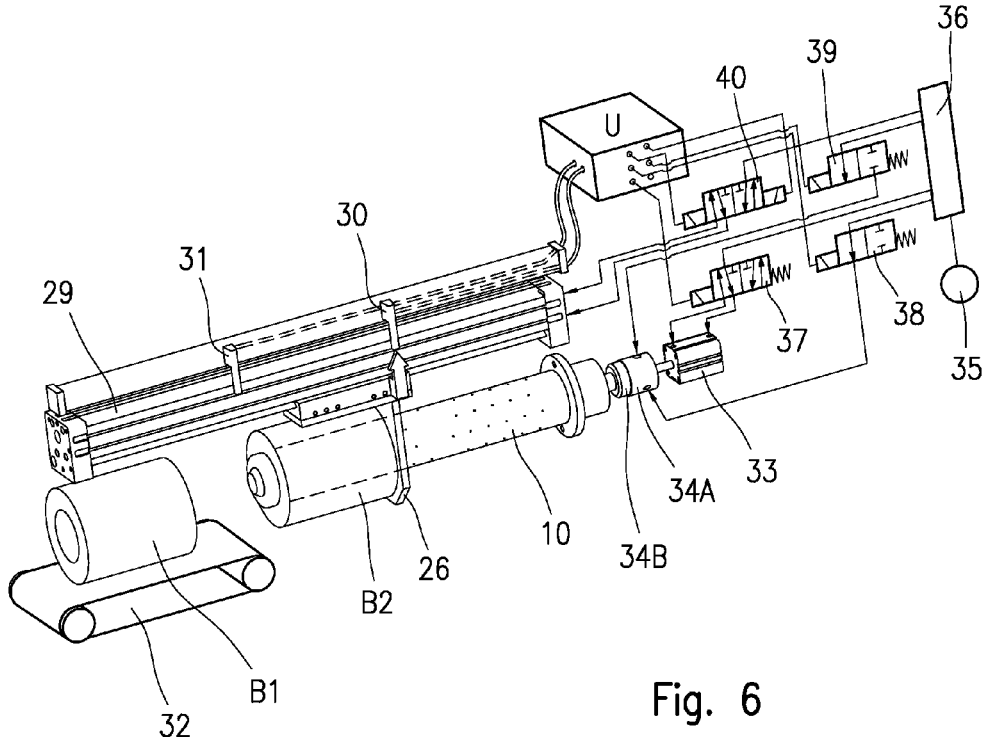
FIG. 6 is a view like the previous figures, showing the removal step for the second roll.

Both rolls B1 and B2 are now simultaneously advanced, step S5, by keeping open the solenoid valves 38, 39 and consequently by maintaining the supply of pressurised air into both chambers 14 and 15 of the mandrel 10. When the first sensor 30 detects that the rear roll B2 has overcome the rear air chamber 15 and reached the fore end of the mandrel 10 at the first air chamber 14, step S6, and consequently the first roll B1 has been pushed on the conveyor belt 32, FIG. 6, said sensor 30 sends a reference signal to the control unit U; the control unit U, on the basis of its own working program, drives the solenoid valve 38 to close the supply of pressurised air into the rear air chamber 15, step S7, by maintaining the supply of pressurised air into the fore air chamber 14 and the cylinder 29 that controls the roll pushing device 26.

Figure 7:
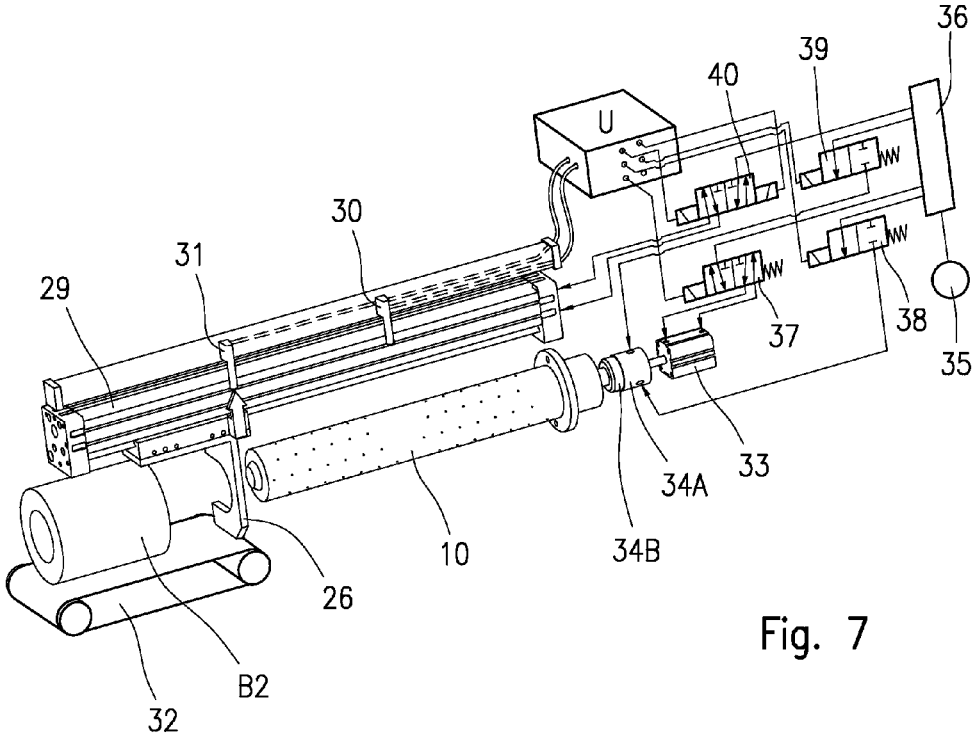
FIG. 7 is a view like the previous figures, at the end of the removal of the rolls.

As advancing of the pushing device 26 with the second roll B2 continues, step S8, the second roll B2 also is removed and pushed on the conveyor belt 32, FIG. 7, whilst the second sensor 31 detects the end stroke position of the pushing device 26, step S9, sending a signal to the control unit U; said control unit U controls the solenoid valve 39 to close the supply of pressurised air into the first chamber 14 of the mandrel, step S10; subsequently, the supply of air to the cylinder 29 is reversed so that the pushing device 26 is moved back and returned to the starting position of FIG. 2, step S10, while the working cycle is terminated.

The main advantage of the method and the apparatus according to the present invention resides therefore in a substantial reduction of the consumption of pressurised air, that can be evaluated indicatively as about 50% of a single-chamber mandrel, for example of the type disclosed by WO-A-2006/012933; all that can be better explained with reference to the graph of FIG. 9.

Figure 9:
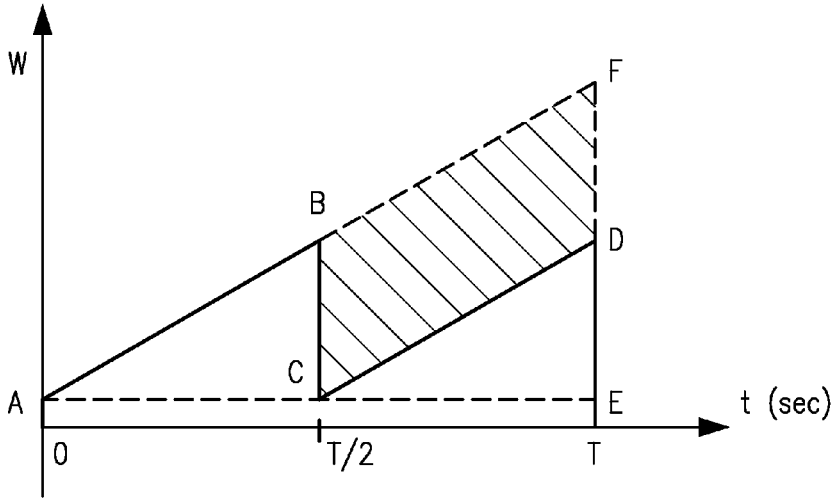
FIG. 9 is a graph showing the consumption of pressurised air, with a double chamber mandrel according to the invention, compared to single chamber conventional mandrel.

FIG. 9 shows the graph of the consumption of air W with reference to the time t, wherein the continuous line A, B, C, D, E indicates the consumption of air during a working cycle for the two chambers mandrel 10 according to the invention, whereas the straight line A, B, F indicates the consumption of air for a single chamber mandrel according to WO-A-2006/012933, or equivalent solution according to EP-A-1812534, wherein the flow rate of pressurised air is kept constant during the overall removing cycle of the rolls.

Therefore, supposing that the speed for removing the rolls B1 and B2 is constant, and the consumption of air follows a linear law; supposing as well that the leakage of air between mandrel 10 and rolls B1, B2 is constant, equal to 10% of the total consumption, as indicated by the broken line A, C, E in FIG. 9; during the removal of the first roll B1, the consumption of air between the instants 0 and T/2 of the total time T for removing both rolls B1 and B2, is given by area of the triangle A, B, C. At the instant T/2, as previously disclosed, the supply of air into the chamber 15 is closed, whereas the supplying of air is maintained into the chamber 14 of the mandrel; therefore, at that instant, the consumption of air will be reduced, passing from the point B to the point C and then continuing along the straight line C, D during the removal of the second roll B2, for being closed in D at the instant T.

Conversely, in the case of a mandrel having a single air chamber, the consumption of air, starting from the point B, would continue along the broken line up to F until said consumption of air is newly interrupted at the instant T; the hatched area included inside the parallelogram B, F, D, C represents the larger consumption of air for a mandrel with a single air chamber, and consequently said hatched area represents the substantial saving of pressurised air and more in general the saving of energy that can be achieved with the method and a mandrel having separate air chambers selectively and sequentially disconnectable from the air source according to the present invention.

All above can be demonstrated on the basis of the following reasoning: as previously reported in relation to the graph of FIG. 9, the total time for removing both rolls B1 and B2 from the mandrel 10 is indicated once again with T and the time for removing the first roll is indicated with T/2. The air source is further supposed to have a pressure P of constant value; when the volume of air flowing through the holes, per unit of second and per unit of area of the mandrel section, is indicated by K and said volume is expressed by normal-liters (NI), during the time T/2 the holes pertaining to the rear chamber 15 will be progressively cleared, with a consumption of air W1 given by the following formula, the leakage A, C, E being excluded:

$$W1=(P\times Q1/2)\times T/2\times K \qquad 1)$$

wherein:

W1=total consumption of air for removing the first roll B1, said total consumption being equal to the area of the triangle A, B, C of FIG. 9;

P=pressure of the air source;

Q1=overall area of the holes 18 pertaining to the chamber 15;

T/2=time for removing the first roll B1;

K=specific volume of air per second and per unit of section of the mandrel.

At this point, as previously reported, the roll B1 results taken off and the supply of the rear chamber 15 can be stopped, while the supply of air into the fore chamber 14 is maintained, since the roll B2 results positioned over the chamber 14.

Like all previously reported, the consumption of air for removing the second roll B2 will be given, in turn, by the following formula:

$$W2=(P\times Q2/2)\times T/2\times K \qquad 2)$$

wherein the various symbols have the previously indicated meaning, and Q2 is the overall area of the holes 18 pertaining to the chamber 14.

Thus, the overall consumption of air WC for removing both rolls B1, B2, a 10% leakage due to the air seeping between mandrel and rolls being also considered, will be equal to:

$$WC1=(W1+W2)\times 1,1 \qquad 3)$$

The previous formula 1 and 2 being considered, one obtains:

$$WC1=P\times(Q1+Q2)/2\times T/2\times 1,1K \qquad 4)$$

Conversely, the consumption of air in the case of a single chamber mandrel is given by the following formula:

$$WC2=P\times(Q1+Q2)/2\times T\times 1,1K \qquad 5)$$

By comparing formula 4 with formula 5, it follows that, in the case of a mandrel with two independent air chambers in which the air flow is selectively and sequentially interrupted, the consumption of air is equal to one half the consumption of a single chamber mandrel.

Always as an example, an energy balance can be carried out to confirm the value of the proposed solution, by giving real values to the variables, as hereinafter indicated:

| | | |
|---|---|---|
| P = 8 bar | Q1 = 27 mm2 | Q2 = 27 mm2 |
| T = 4 sec. | K = 1, 6 NI/sec mm2 | |

On the basis of the formulas and the values of previously indicated parameters, in the case of a conventional mandrel, a consumption of air equal to 180 NI per cycle is obtained. Considering that the apparatus completes, on average, three cycles every sixty seconds, a consumption per hour of 32400 NI of air will be obtained.

Supposing that 1 KWh is required, on average, for producing 6000 NI of pressurised air, a consumption of electric energy per hour equal to 5.4 KWh will result.

Since, in the case of the double-chamber mandrel according to the present invention, a consumption of air substantially is equal to one half the consumption of a conventional single chamber mandrel, supposing that the apparatus is at work 300 days per year over two working turns, an energy saving equal to 9.6 MWh would be obtained.

From all said and shown in the example of the enclosed drawings, it will be appreciated that a mandrel and an apparatus have been provided for simultaneously winding up two or a plurality of rolls of a stretchable plastic film, said mandrel and apparatus being able to carry out the removal of the rolls by a fully innovative method.

As well, it will be understood that all was said and shown in the enclosed drawings, was given as an illustrative example of the general features of the mandrel, the winding apparatus and relative method for winding up e removing the rolls.

Therefore, the mandrel and the apparatus can be conformed and arranged for winding up whether a single roll substantially extending for the entire length of the mandrel 10, or two or a plurality of rolls at the same time of shorter length, by providing a mandrel with two or a plurality of air chambers that are selectively, sequentially deactivated during the removal of the rolls. Thus, the advantages previously reported are achieved, in particular a substantial reduction of the air consumption is achieved with respect to conventional mandrels.

In the case of the enclosed drawings, an apparatus was shown comprising a single mandrel 10 attached to a support by the flange 21; however, an apparatus can also be provided with two or a plurality of mandrels 10 supported by a carousel or by a rotatable support member about a central axis, wherein a control system, step-by-step indexed, is used for moving the single mandrels between a plurality of operative positions, along a circular path, between a position for winding up the rolls and a position for removing the rolls, moving the single mandrels 10 through one or a plurality of intermediate positions for stabilising the tensioning in the wound rolls.

Therefore, other modifications or variations can be made to the method, the mandrel, and the apparatus for winding up rolls without thereby departing from the appended claims.

The invention claimed is:

1. A method for winding up and removing one or a plurality of coreless rolls of a stretchable plastic film on a mandrel comprising a tubular body having a peripheral wall provided with a plurality of perforations or holes, in which said wall extends longitudinally from a rear to a fore end of the mandrel, and means for supplying pressurized air in the tubular body of the mandrel and out through the holes during removal of the roll or rolls, wherein at least one roll or a plurality of rolls of the stretchable plastic film are wound up on said perforated zones of the mandrel, comprising the steps of:

providing the tubular body of the mandrel with at least a first fore air chamber and a second rear air chamber, axially aligned, at respective fore and rear perforated zones of the peripheral wall of the mandrel;

connecting the air chambers of the mandrel to a pressurized air source by a duct system comprising selectively actuable control valves;

removing the roll or the plurality of rolls, by initially supplying pressurized air in all the air chambers of the mandrel during a first removal step of the roll or rolls; and subsequently selectively disconnecting each single air chamber from the pressurized air source during a second removal step of the roll or rolls, starting from the rear air chamber (15), towards the fore air chamber of the mandrel.

2. The method according to claim 1, comprising the steps of:

detecting the position of a rear roll of said plurality of rolls moving along the mandrel; and sequentially disconnecting each single air chamber from the pressurized air source on passing of a perforated zone of the mandrel by said rear roll.

3. The method according to claim 1, comprising the steps of:

winding up a plurality of axially spaced apart rolls, on respective perforated zones of the peripheral wall, at corresponding air chambers of the mandrel;

supplying pressurized air into the all air chambers of the mandrel during an initial approaching step to contact the rolls;

moving the rolls in a contacted condition, by simultaneously supplying pressurized air into the air chambers of the mandrel;

detecting the position of a rear roll of said plurality of rolls during movement along the mandrel; and sequentially disconnecting each single air chamber from the pressurized air source on overcoming of each air chamber by said rear roll.

4. The method according to claim 1, comprising the steps of:

supplying an air flow into the air chambers of the mandrel, at a constant pressure value; and reducing the air flow by maintaining the pressure at a constant value, on disconnection of each air chamber of the mandrel from the pressurized air source.

5. A mandrel for winding up and removing one or a plurality of coreless rolls of a stretchable plastic film according to the method of claim 1, the mandrel comprising a tubular cylindrical body having a peripheral wall provided with a plurality of perforations or holes into which a pressurized air flow is supplied during removal of a roll or the plurality of rolls wherein the tubular body of the mandrel comprises:

a plurality of separate air chambers axially aligned between a rear air chamber at the rear end and a fore end of the mandrel; and an air duct and valve system comprising a plurality of air ducts and a rotating pneumatic coupling device conformed to separately supply and sequentially disconnect the pressurized air from each single air chamber of the mandrel, starting from the rear air chamber, towards the fore air chamber of the mandrel.

6. The mandrel according to claim 5, wherein the peripheral wall of the mandrel comprises a perforated zone at said each single air chamber.

7. The mandrel according to claim 5, wherein said plurality of air supply ducts are coaxially extending from the rear end of the mandrel, opening into a respective air chamber of the mandrel.

8. The mandrel according to claim 7, comprising a first and a second axially aligned air chambers;

support means conformed to support the mandrel in a freely rotating manner; and a pneumatic coupling device conformed to separately connect each of said first and second axially aligned air chambers to the pressurized air source.

9. The mandrel according to claim 8, comprising:

a first tubular member defining a first duct for supplying pressurized air to a first fore chamber;

a second tubular member coaxially arranged to the first tubular member, said first and second tubular member defining a second annular duct for supplying pressurized air to a second rear air chamber; and a rotational coupling device for connecting said tubular members to the pressurized air source.

10. An apparatus for winding up one or a plurality of coreless rolls of a stretchable plastic film with at least one mandrel according to claim 5, said apparatus comprising:

a roll pushing device operatively connected to a first actuator conformed to move the roll pushing device from a rear to a fore end of the mandrel;

a pneumatic coupling device connectable to the air chambers of the mandrel and a control valve system conformed to connect the air chambers of the mandrel by said coupling device to a pressurized air source;

an electronic control unit operatively connected to the actuator of the roll pushing device and the valve system for the connection to the pressurized air source; and at least one position sensing device conformed and arranged to detect the position of the single roll or of one of the plurality of rolls overcoming said air chambers and to provide a control signal to the control unit;

the electronic control unit being programmed and operatively connected to the valve system to selectively connect and disconnect the air chambers from the pressurized air source as a function of control signals from the position sensing device to the control unit.

11. The apparatus according to claim 10, comprising at least a first and a second mandrel parallel extending from a rotatable support member; and indexing means to control a step-by-step rotation of the support member and move said at least first and second mandrel, along a circular working path between a winding up position and a removal position of the rolls.

* * * * *